US008152704B2

(12) United States Patent
Brice et al.

(10) Patent No.: US 8,152,704 B2
(45) Date of Patent: Apr. 10, 2012

(54) PULLEY TRAINING SYSTEM

(75) Inventors: John P. Brice, Rancho Cucamonga, CA (US); Brendan E. Cosso, Duarte, CA (US)

(73) Assignee: Crosscore, Inc., Duarte, CA (US)

( * ) Notice: Subject to any disclaimer, the term of this patent is extended or adjusted under 35 U.S.C. 154(b) by 0 days.

(21) Appl. No.: 12/683,600

(22) Filed: Jan. 7, 2010

(65) Prior Publication Data

US 2011/0166003 A1 Jul. 7, 2011

(51) Int. Cl.
*A63B 21/04* (2006.01)

(52) U.S. Cl. ..... 482/129; 482/131; 482/904

(58) Field of Classification Search ..... 482/121–130, 482/131, 904; 473/207, 208, 212–217
See application file for complete search history.

(56) References Cited

U.S. PATENT DOCUMENTS

| | | | | | |
|---|---|---|---|---|---|
| 2,716,027 | A * | 8/1955 | Gehri | 482/131 |
| 3,843,119 | A * | 10/1974 | Davis | 482/131 |
| 3,999,752 | A * | 12/1976 | Kupperman et al. | 482/131 |
| 4,060,240 | A * | 11/1977 | Dunston | 482/131 |
| 4,109,907 | A * | 8/1978 | Zito | 482/94 |
| 4,119,300 | A * | 10/1978 | Goudey | 254/391 |
| 4,205,839 | A * | 6/1980 | Best | 482/131 |
| 4,229,002 | A | 10/1980 | Masters | |
| 4,257,592 | A * | 3/1981 | Jones | 482/131 |
| 4,667,625 | A * | 5/1987 | Malone | 119/785 |
| 4,709,922 | A * | 12/1987 | Slade et al. | 482/104 |
| 5,158,517 | A * | 10/1992 | Steggert | 482/98 |
| 5,171,295 | A | 12/1992 | Schwalm, Jr. | |
| 5,261,865 | A * | 11/1993 | Trainor | 482/95 |
| 5,423,730 | A * | 6/1995 | Hirsch | 482/92 |
| 5,944,640 | A | 8/1999 | Larsson | |
| 6,712,181 | B2 * | 3/2004 | Nichols | 182/192 |
| 7,044,896 | B2 | 5/2006 | Hetrick | |
| 7,354,384 | B2 * | 4/2008 | Martin et al. | 482/92 |
| 7,419,138 | B1 * | 9/2008 | Mauthner | 254/394 |
| 7,614,984 | B1 * | 11/2009 | Krull | 482/131 |
| 7,762,932 | B2 | 7/2010 | Hetrick | |
| 7,785,243 | B2 * | 8/2010 | Kassel | 482/122 |
| 7,785,244 | B2 | 8/2010 | Hetrick | |
| 7,806,814 | B2 | 10/2010 | Hetrick | |
| 2005/0092545 | A1 * | 5/2005 | Jones | 182/3 |
| 2007/0142185 | A1 * | 6/2007 | Woodman et al. | 482/69 |
| 2008/0283137 | A1 * | 11/2008 | Davis et al. | 138/103 |
| 2010/0292056 | A1 * | 11/2010 | Birch et al. | 482/129 |
| 2011/0207586 | A1 * | 8/2011 | Whyatt et al. | 482/139 |

OTHER PUBLICATIONS

Fitness Anywhere.Com, Home of TRX Suspension Training, http://www.fitnessanywhere.com.
Perform Better, AirFit Trainer Pro, http://www.performbetter.com.
Perform Better, Versus, http://www.performbetter.com.
Purmotion, AirFit Trainer Pro, http://www.purmotion.net.
Purmotion, PURMOTION Funtional Training Station, http://www.facebook.com, Aug. 30, 2009.

* cited by examiner

*Primary Examiner* — Loan Thanh
*Assistant Examiner* — Daniel F Roland
(74) *Attorney, Agent, or Firm* — Sheppard, Mullin, Richter & Hampton LLP

(57) ABSTRACT

The present invention resides in a pulley training system comprising a pulley wheel mounted on an axle within a pulley housing and a cord configured to be draped over the pulley wheel. An attachment strap may be configured to be adjustably attached to the pulley housing. A first clip may be configured to be attached proximate a first end of the cord, and a second clip may be configured to be attached proximate a second end of the cord.

19 Claims, 9 Drawing Sheets

PULLEY TRAINING SYSTEM

FIELD OF THE INVENTION

The present invention pertains to exercise devices and, more particularly to pulley-based exercise devices.

BACKGROUND OF THE INVENTION

A number of pulley-based exercise devices exist in the market. Many of these devices are designed to be anchored to a door, doorknob, or bed post. These devices typically comprise two pulleys and a rope, with two hand grips (one attached at each end of the rope, such as shown in U.S. Pat. No. 5,171,295 to Schwalm) or with a hand grip and a weight (one attached at each end of the rope, such as shown in U.S. Pat. No. 4,229,002 to Masters). Vigorous exercises typically cannot be performed with these devices because, among other things, the anchor is too weak or the rope would rub excessively on the sides of one or both of the pulleys. Also, these devices are compatible with an undesirably limited number and variety of exercises because only a few body positions may be assumed with respect to the devices and because the devices may be used in only a few configurations. Additionally, many of these devices are not easily portable, cannot be attached to a wide variety of horizontal and vertical structures, and cannot support a person's full body weight.

Attempts have been made to strengthen the anchors of pulley-based exercise devices and to increase the number and variety of exercises that may be performed with them. One example is disclosed in U.S. Pat. No. 4,060,240 to Dunston, which comprises a single pulley and a rope. These attempts, however, have not provided a satisfactory solution to the problems that are involved in the prior art.

Accordingly, there is a need for a pulley-based exercise device that is compatible with a wide variety of exercises and body positions, can withstand the forces of vigorous exercise, can be used in many configurations, and can be attached to most any vertical or horizontal support. The present invention satisfies this and other needs, and provides further related advantages.

SUMMARY OF THE INVENTION

The present invention resides in a pulley training system comprising a pulley wheel mounted on an axle within a pulley housing and a cord configured to be draped over the pulley wheel. An attachment strap may be configured to be adjustably attached to the pulley housing. A first clip may be configured to be attached proximate a first end of the cord, and a second clip may be configured to be attached proximate a second end of the cord.

In one embodiment, each clip is a carabiner, spring clip, or snap hook, and the attachment strap has a buckle attached proximate one end thereof. The attachment strap allows the pulley housing to be raised or lowered to a desired height. A grip in the form of a handle or an arm/foot cradle may be removably attached to one or both clips. A door anchor, such as a slide plate, or wall/ceiling anchor may be removably coupled to the attachment strap for hanging the pulley training system from a door, wall, or ceiling. A threaded fastener, such as a screw or bolt, may be used to affix the wall/ceiling anchor to a wall or ceiling. After the wall/ceiling anchor is bolted to a supporting object, the attachment strap can be fed through the anchor and through an attachment brace welded to the top of the pulley housing. The anchor may be configured to accept one attachment strap or a plurality of attachment straps.

In one embodiment, a generally parabolic groove is formed between two flanges around the circumference of the pulley wheel. The groove inhibits the cord from rubbing on the pulley housing. The circumference of each flange is slightly tapered inward toward the groove.

In another embodiment, the pulley housing comprises a first portion extending over a first face of the pulley wheel and a second portion extending over a second face of the pulley wheel. A first locking hole is formed in the first portion of the pulley housing, and a second locking hole is formed in the second portion of the pulley housing. A third locking hole is formed through the pulley wheel. The first, second, and third locking holes are configured so that they can be aligned and receive a locking pin for stopping the pulley wheel from rotating relative to the pulley housing. The locking pin provides the pulley training system with two modes: a "static" mode in which the pulley wheel is substantially prevented from rotating relative to the pulley housing and an "open" mode in which the pulley wheel is allowed to rotate freely relative to the pulley housing.

In a further embodiment, a first clip hole and a second clip hole are formed in the pulley housing in an area spaced from the pulley wheel. The first and second clip holes are sized to allow the first and second clips to be removably attached to the pulley housing through the clip holes. In this configuration, the pulley training system may be used for exercises that do not require the rotation of the pulley wheel, such as pull ups. Other hanging exercise devices, such as a boxing hag, may be hung from the first and second clips in this configuration, making the pulley training system a central location for exercises of many different kinds.

Other features and advantages of the invention will become apparent from the following detailed description of the preferred embodiments taken with the accompanying drawings, which illustrate, by way of example, the principles of the invention.

BRIEF DESCRIPTION OF THE DRAWINGS

Embodiments of the present invention will now be described, by way of example only, with reference to the following drawings.

DETAILED DESCRIPTION OF THE PREFERRED EMBODIMENTS

Figure 1:
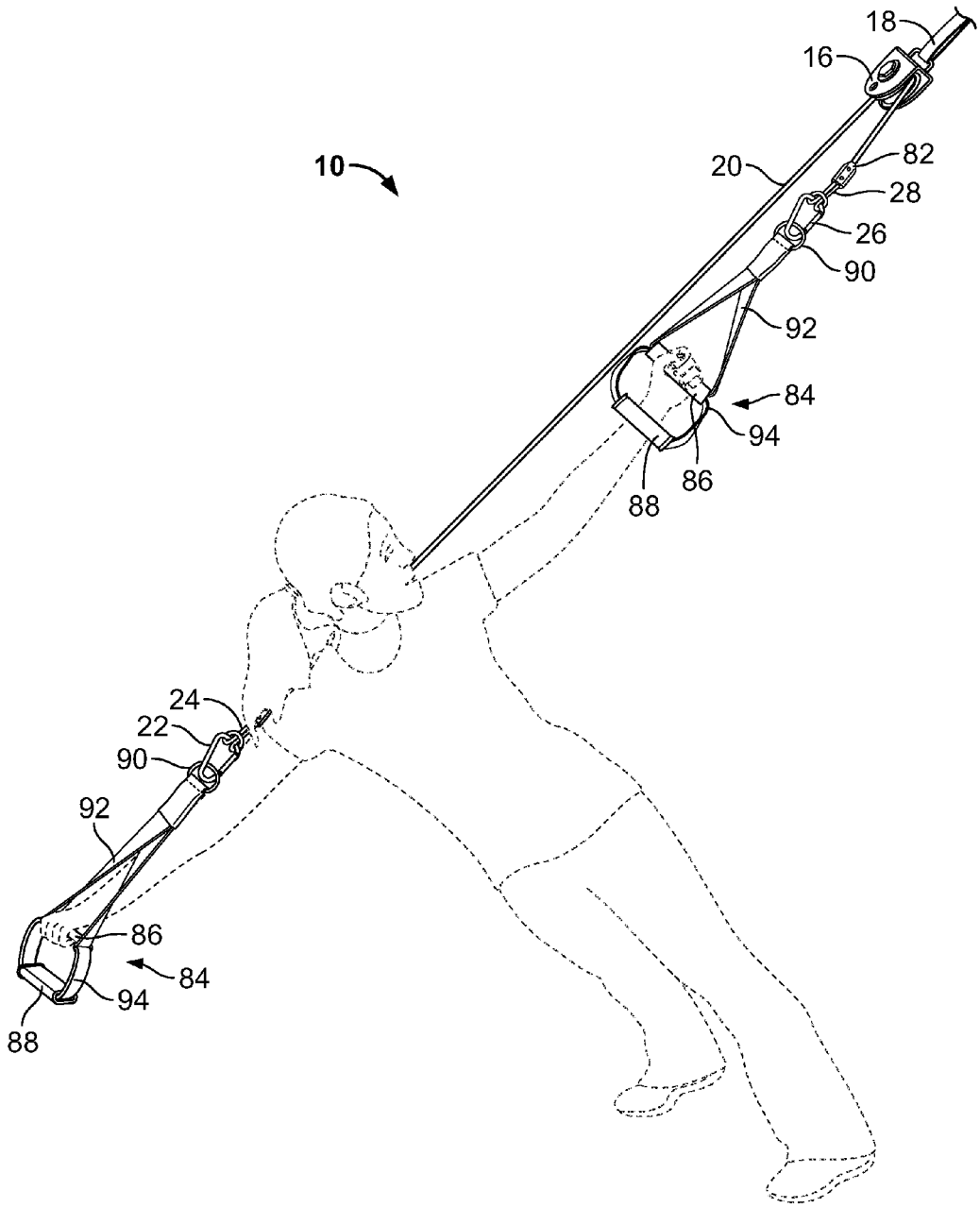
FIG. 1 is a perspective view of a first embodiment of a pulley training system in accordance with the present invention, the pulley training system being used by a person.
Figure 2:
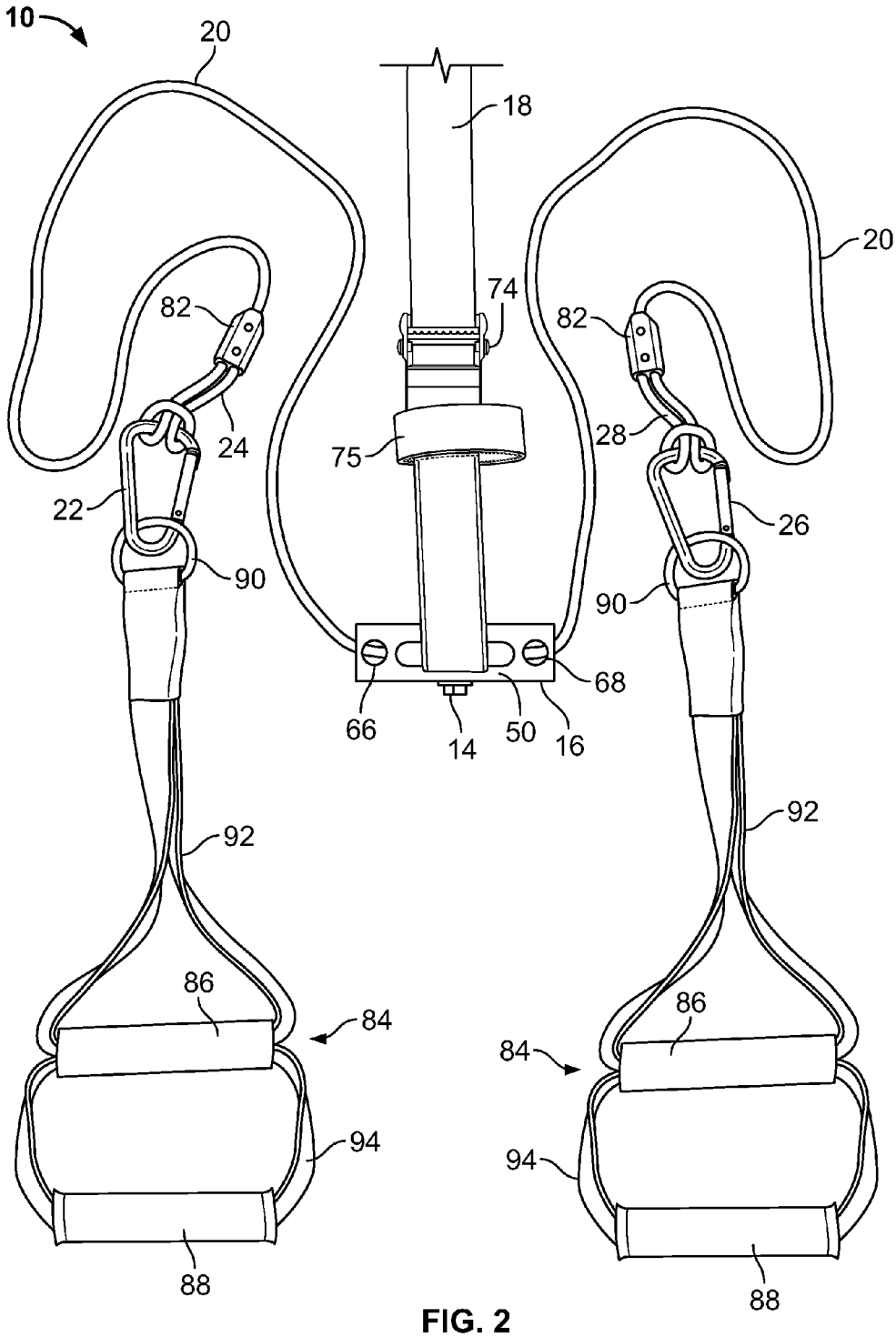
FIG. 2 is a top plan view of the pulley training system of FIG. 1.
Figure 3:
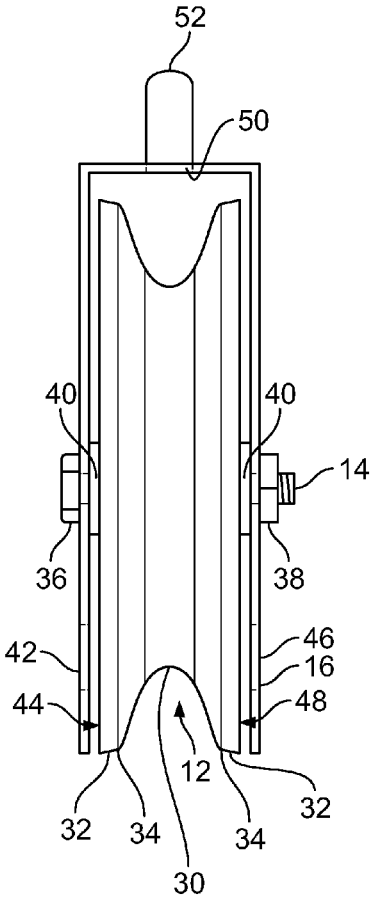
FIG. 3 is a side elevation view of a pulley wheel, pulley axle, and pulley housing for the pulley training system of FIG. 1, in accordance with an embodiment of the present invention.
Figure 4:
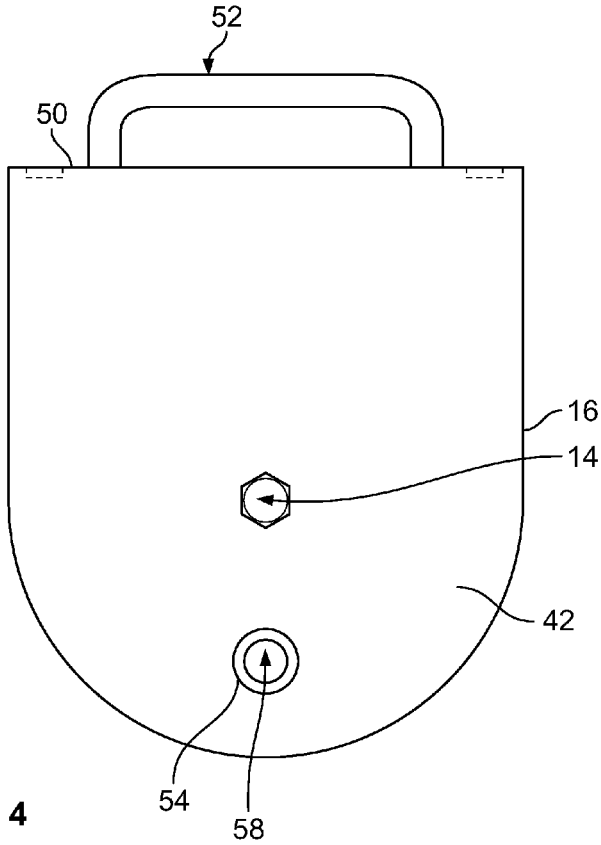
FIG. 4 is a front elevation view of the pulley housing of FIG. 3.
Figure 5:
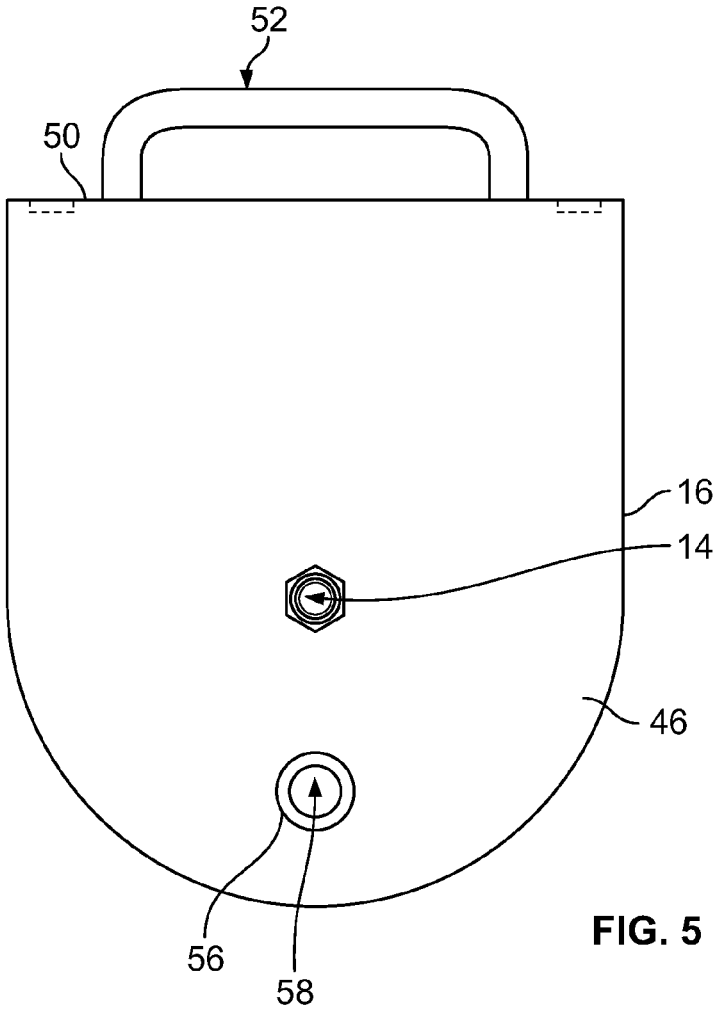
FIG. 5 is a rear elevation view of the pulley housing of FIG. 3.

Referring now to the drawings, and particularly to FIGS. 1-5 thereof, there is shown a first embodiment of a pulley training system 10 in accordance with the present invention, the pulley training system being used by a person. The pulley training system comprises a pulley wheel 12 mounted on an axle 14 within a pulley housing 16, an attachment strap 18 configured to be adjustably attached to the pulley housing, a cord 20 configured to be draped over the pulley wheel, a first clip 22 configured to be attached proximate a first end 24 of the cord, and a second clip 26 configured to be attached proximate a second end 28 of the cord.

The pulley wheel 12 is configured to rotate about its center and is made of metal or a hard, durable plastic. In a preferred embodiment, the pulley wheel has a diameter of approximately 4 inches to approximately 5 inches and, in a more preferred embodiment, has a diameter of approximately 4½ inches. In a preferred embodiment, the pulley wheel has a width of approximately ½ inch to approximately 1 inch and, in a more preferred embodiment, has a width of approximately ¾ inch.

In one embodiment, a generally parabolic groove 30 is formed between two flanges 32 around the circumference of the pulley wheel 12. The groove inhibits the cord 20 from rubbing on the pulley housing 16. In a preferred embodiment, the depth of the groove is approximately 25 percent to approximately 75 percent greater than the diameter of the cord and, in a more preferred embodiment, is approximately 50 percent greater than the diameter of the cord. In a preferred embodiment, the width of the groove at its maximum extent is approximately 50 percent to approximately 200 percent greater than the diameter of the cord and, in a more preferred embodiment, is approximately 100 percent greater than the diameter of the cord. The circumference of each flange has a slight taper 34 inward toward the groove. In a preferred embodiment, the diameter of the cord is approximately 50 percent to approximately 200 percent greater than the width of each flange and, in a more preferred embodiment, is approximately 100 percent greater than the width of each flange.

The axle 14 comprises an approximately 2-inch-long, %-inch-diameter bolt 36 that extends through holes formed in the pulley wheel 12 and pulley housing 16. The bolt may be secured to the pulley housing by a nut 38. Washers 40 may be mounted on the bolt between the pulley wheel and pulley housing to inhibit the pulley wheel from rubbing on the pulley housing.

The pulley housing 16 is made of steel, aluminum, and/or another durable material, and comprises a first portion 42 extending over a first face 44 of the pulley wheel 12, a second portion 46 extending over a second face 48 of the pulley wheel, and a top portion 50 that joins the first portion to the second portion. The first and second portions extend substantially parallel to each other, and the top portion extends substantially perpendicular to the first and second portions. A steel attachment brace 52 may be welded to the top portion and the attachment strap 18 secured thereto. Alternatively, an opening may be formed in the pulley housing for securing the attachment strap (see FIG. 9).

Figure 6:
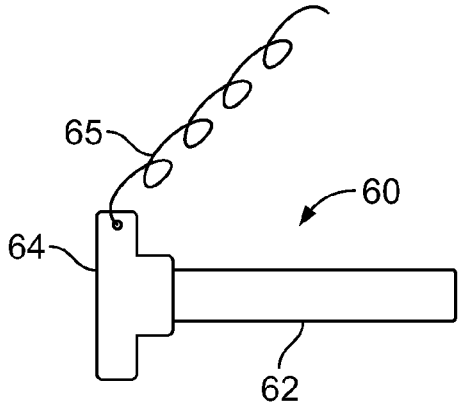
FIG. 6 is a side elevation view of a locking pin and lanyard for the pulley training system of FIG. 1, in accordance with an embodiment of the present invention.
Figure 17:
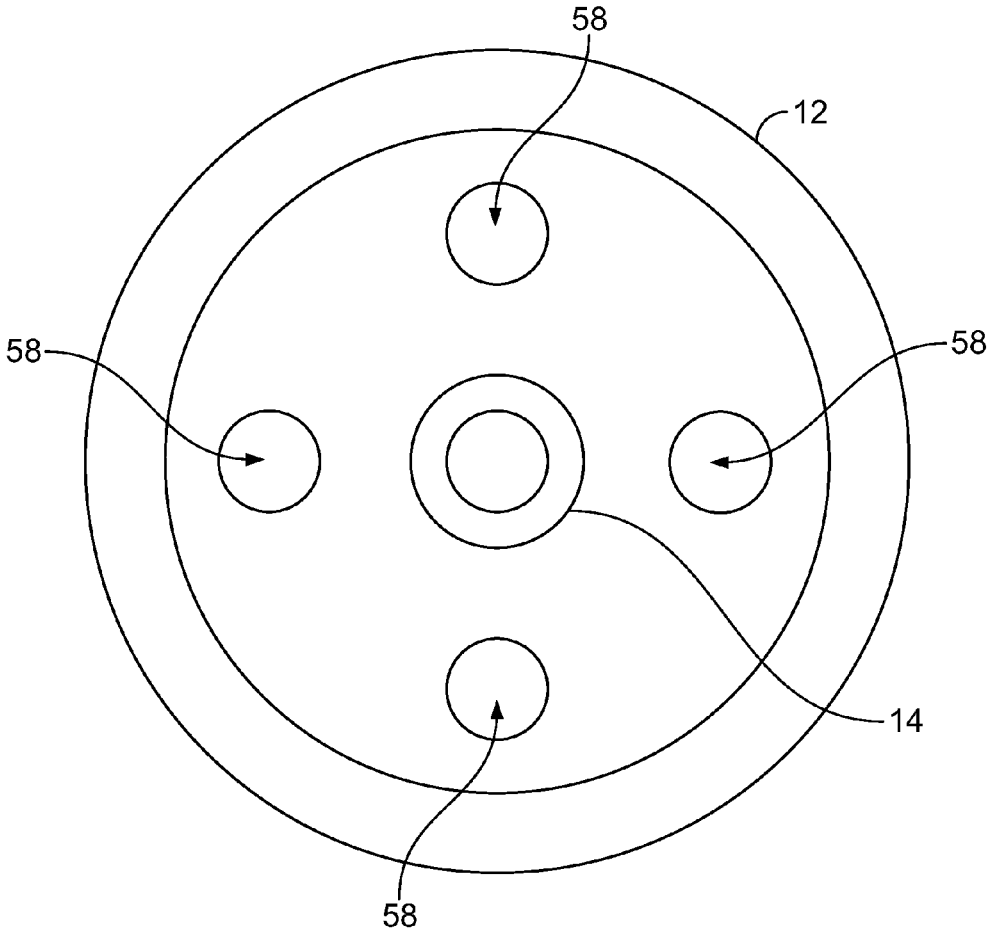
FIG. 17 is a front elevation view of a pulley wheel and axle for use with the pulley training system of FIG. 1, 9, 12 or 14, in accordance with an embodiment of the present invention.

In one embodiment, a first locking hole 54 is formed in the first portion 42 of the pulley housing 16, and a second locking hole 56 is formed in the second portion 46 of the pulley housing. A third locking hole 58 is formed through the pulley wheel 12. The first, second, and third locking holes are configured so that they can be aligned and receive a locking pin 60 (see FIG. 6) for stopping the pulley wheel from rotating relative to the pulley housing. In one embodiment, the first and second locking holes are positioned below the axle 14, so that it is easier for a user to reach the locking pin when the pulley housing is suspended higher in the air. The locking pin comprises a generally cylindrical shaft 62 and a head portion 64. A magnetic material may be incorporated into the locking pin to inhibit it from falling out of the locking holes. In one embodiment, the locking pin has a lanyard 65 that can be used to hang the locking pin from the pulley housing. The locking pin provides the pulley training system 10 with two modes: a "static" mode in which the pulley wheel is substantially prevented from rotating relative to the pulley housing and an "open" mode in which the pulley wheel is allowed to rotate freely relative to the pulley housing. Locking the pulley wheel creates kinetic friction between the pulley wheel and the cord 20 when the cord is pulled, creating greater resistance, which can be helpful for beginning users by creating more stability. In another embodiment, the second locking hole may be omitted and the locking pin may be received in only the first locking hole and third locking hole. In a further embodiment (see FIG. 17), a plurality of locking holes 58 are formed in the pulley wheel, allowing a user to engage the pulley wheel with the locking pin more quickly.

In yet a further embodiment, a first clip hole 66 and a second clip hole 68 are formed proximate the sides of the top portion 50 of the pulley housing 16. The first and second clip holes are sized to allow the clips 22 and 26 to be removably attached to the pulley housing through the clip holes. In this configuration, the pulley training system 10 may be used for exercises that do not require the rotation of the pulley wheel 12, such as pull ups. Other hanging exercise devices, such as a boxing bag, may be hung from the first and second clips in this configuration, making the pulley training system a central location for exercises of many different kinds.

Figure 7:
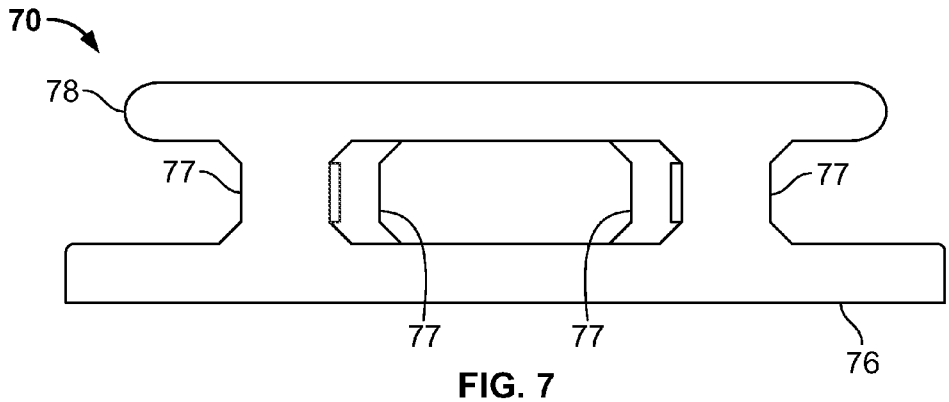
FIG. 7 is a side elevation view of a wall/ceiling anchor for use with the pulley training system of FIG. 1, 9, 12 or 14, in accordance with an embodiment of the present invention.
Figure 8:
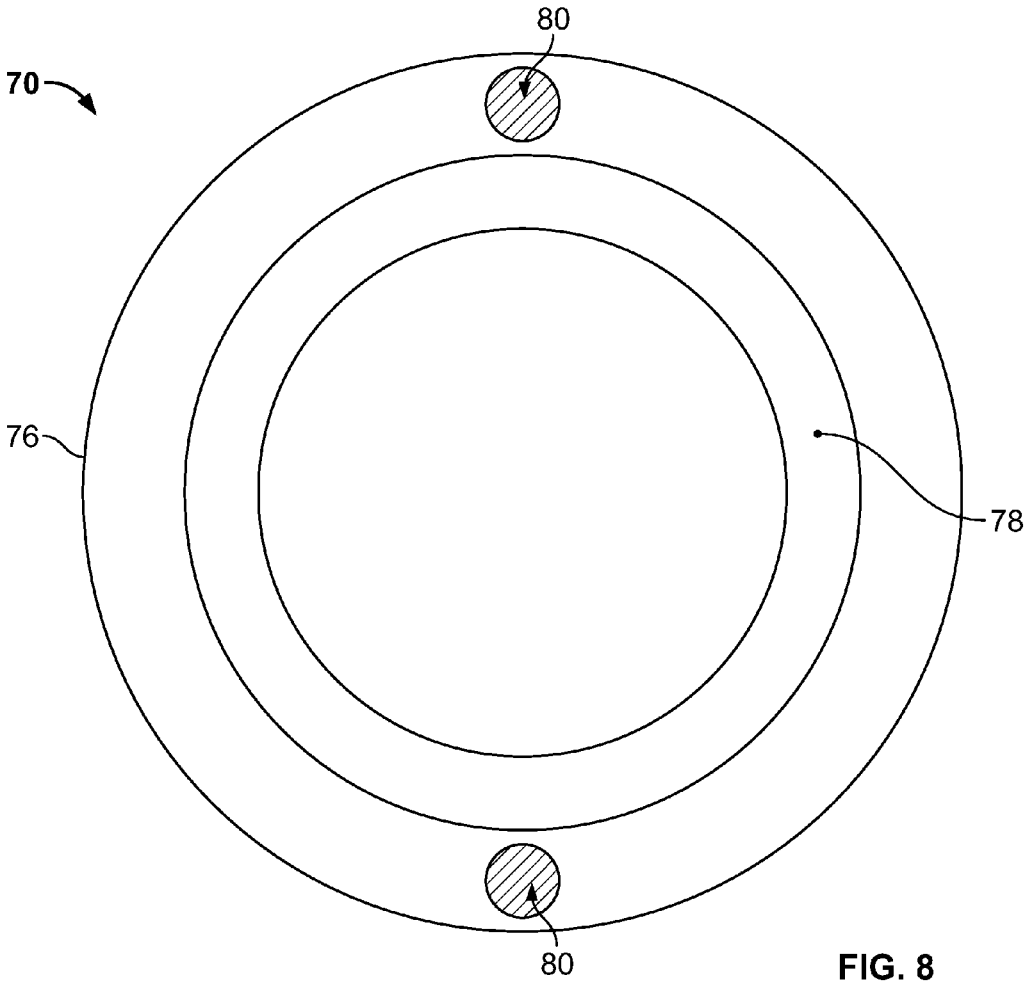
FIG. 8 is a bottom plan view of the wall/ceiling anchor of FIG. 7.
Figure 11:
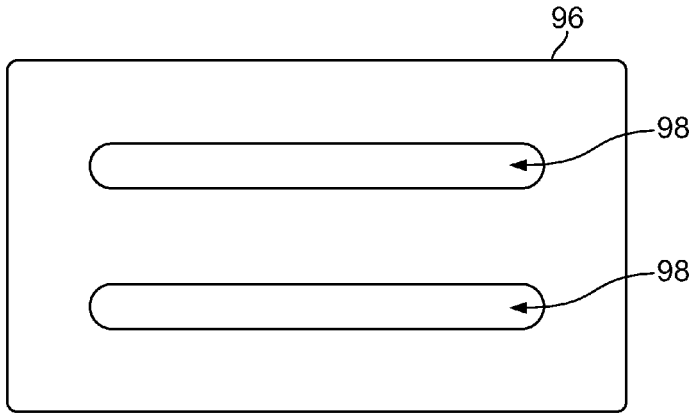
FIG. 11 is a front elevation view of a door anchor for use with the pulley training system of FIG. 1, 9, 12 or 14, in accordance with an embodiment of the present invention.

The attachment strap 18 can be used to removably couple the pulley training system 10 to a door anchor or wall/ceiling anchor, such as the wall/ceiling anchor 70 shown in FIGS. 7 and 8, or the door anchor 96 shown in FIG. 11. In one embodiment, the attachment strap is an approximately 1.5-inch-wide strap comprising a strong synthetic fabric and having a metal buckle 74 attached proximate one end thereof.

Referring now to FIGS. 7 and 8, the wall/ceiling anchor 70 can be an approximately ¼-inch-thick disk-shaped steel mounting plate 76 having four posts 77 welded thereto and a steel strap ring 78 welded to the posts. The attachment strap 18 can be secured to the front, hack, right side, or left side of the strap ring, making the anchor 70 a multi-directional anchor. The anchor 70 may be sized to accommodate multiple straps for multiple pulley training systems. A threaded fastener, such as a screw or bolt, may be used to affix the anchor 70 to a wall or ceiling through %-inch-diameter bolt holes 80 formed in the plate. The anchor 70 allows the pulley training system 10 to be used in almost any place that has a supporting surface to which the anchor can be safely bolted. When a user wants to move the pulley training system to a new location, the pulley training system can be placed in a carrying hag and taken to the new location.

Referring now to FIG. 11, the door anchor 96 allows the pulley training system 10 to be used with almost any door over which the attachment strap 18 can be safely draped. In one embodiment, the door anchor 96 is configured as a slide plate. The attachment strap can be fed through holes 98 in the slide plate. The slide plate keeps the attachment strap from coming through the top of the door when the door is shut, even when the pulley training system is supporting all of a user's body weight.

Referring again to FIGS. 1-5, even without the wall/ceiling anchor 70 or door anchor 96, the attachment strap 18 may be used to removably couple the pulley training system 10 to a tree branch, ceiling beam, pull-up bar, ceiling rack, or other supporting object around which the attachment strap can be wrapped. The attachment strap may be adjusted using the buckle 74, allowing a user to adjust the pulley housing 16 to an appropriate height for the user. A holding strap 75 attached to the attachment strap may be used to hold excess portions of the attachment strap out of the way during use. The holding strap 75 may comprise a hook-and-loop fastener, such as Velcro.

The cord 20 can be a rope made of a strong synthetic fiber material. Rope clamps 82 are provided at both ends of the cord to fix the ends back to the cord and create a loop. The rope clamps provide added safety to the user and an aesthetically pleasing way to hide the ends of the cord. The clips 22 and 26 may be tied to the loops using a Prusik knot or other appropriate knot. The length of the usable portion of the cord may be adjusted by making a cord-length adjustment knot (such as a Prusik knot) anywhere in the cord and inserting the clip 22 or the clip 26 through the knot. The cord-length adjustment knot may be made on the cord on only one side of the pulley wheel 12, or knots may be made on the cord on both sides of the pulley wheel. By adjusting the length of the usable portion of the cord, a user can perform exercises that require different cord lengths.

Each clip 22 and 26 is a metal carabiner, spring clip, or snap hook, such as a non-locking, straight gate, offset-D carabiner meeting the EN362 standard and having a major-axis strength of approximately 23 kilonewtons, a minor-axis strength of approximately 7 kilonewtons, and an open-gate strength of approximately 7 kilonewtons.

A grip 84 may be removably attached to one or both clips. The grip 84 may comprise both a substantially rigid hand grip or handle 86 and a relatively flexible arm/foot cradle 88, which are both connected to a metal D-shaped ring 90 by a grip strap 92 made of a strong synthetic fabric. In one embodiment, the grip strap 92 connects the hand grip to the D-shaped ring, and a separate cradle strap 94 connects the arm/foot cradle to the hand grip. The hand grip 86 may be configured as a padded, hollow, plastic cylinder. The arm/foot cradle may be configured as a soft leather tube, which allows a user to engage the arm/foot cradle in the crook of the arm to perform exercises, such as knee raises, without the cradle strap 94 cutting into the skin. In another embodiment, a grip bar having a clip hole proximate each end can be removably attached to both clips, permitting an even wider variety of exercises. A grip bar can add stability when exercising certain muscles.

Unlike a traditional pulley-based exercise device, the pulley training system 10 allows the angle and position of the user's body to determine how much resistance the user feels. As the angle of the body increases, more of the user's body weight comes into play. Resistance thus can range from none of the user's body weight (the only resistance coming from friction in the pulley training system itself) to all of the user's body weight, depending upon the angle and position of the body. The pulley training system can provide a safe workout for beginners, while also providing a vigorous workout for experts. Additionally, cord lengths on either side of the pulley wheel are "self leveling" because of the pulley wheel. One side of the cord being longer than the other would not be an issue to the user.

Well conditioned athletes can perform certain exercises using the pulley training system 10 without any body part contacting the floor or other surface. The user can be fully suspended from the grips 84 and perform certain exercises with all of the user's body weight as resistance. In one embodiment, the pulley training system has a minimum weight rating of 1,000 pounds.

As shown, the pulley training system 10 can be used in many configurations and permits three-dimensional movement natural to the biomechanics of the human body. The pulley training system 10 is not "muscle specific" and can provide an effective workout for a wide variety of muscles. For example, the user can hold a hand grip 86 with one hand and place a foot in an arm/foot cradle 88, for performing both upper and lower body exercises simultaneously. Additionally, a user can perform an exercise in a static fashion (meaning that the pulley wheel 12 is substantially still throughout the exercise) or in a dynamic fashion (wherein the pulley wheel turns). The user may exercise the upper body, the lower body, or both simultaneously, and may exercise the right side of the body, the left side of the body, or both simultaneously. The user may use his or her own body weight as resistance, or may attach a resistance strap or counter balance (such as a weight plate) to one of the clips 22 or 26. In one configuration, the clips may be clipped together so that they can be used simultaneously for the same body part, such as supporting just one foot when one-legged squats are performed. In another configuration, two users, one at each grip 84, can use the pulley training system simultaneously, each user providing resistance to the other. The grips 84 may be changed out so that other "cable attachment"-type exercise devices can be attached to the clips.

Figure 10:
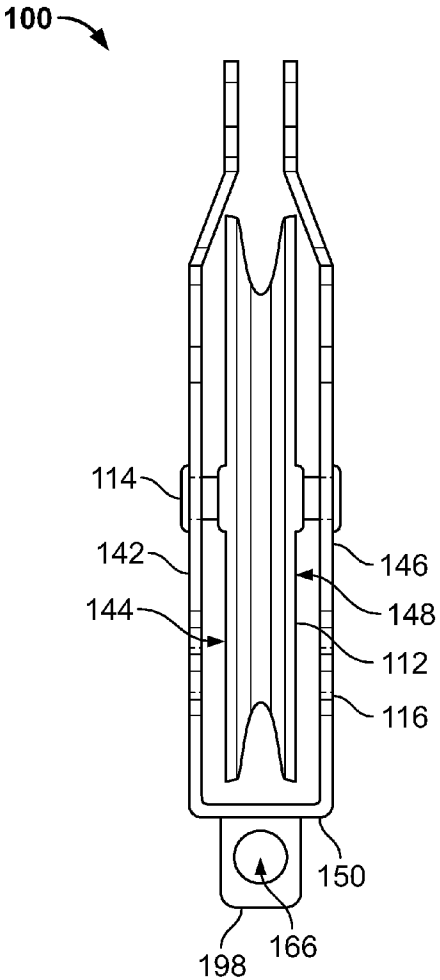
FIG. 10 is side elevation view of the pulley training system of FIG. 9.
Figure 9:
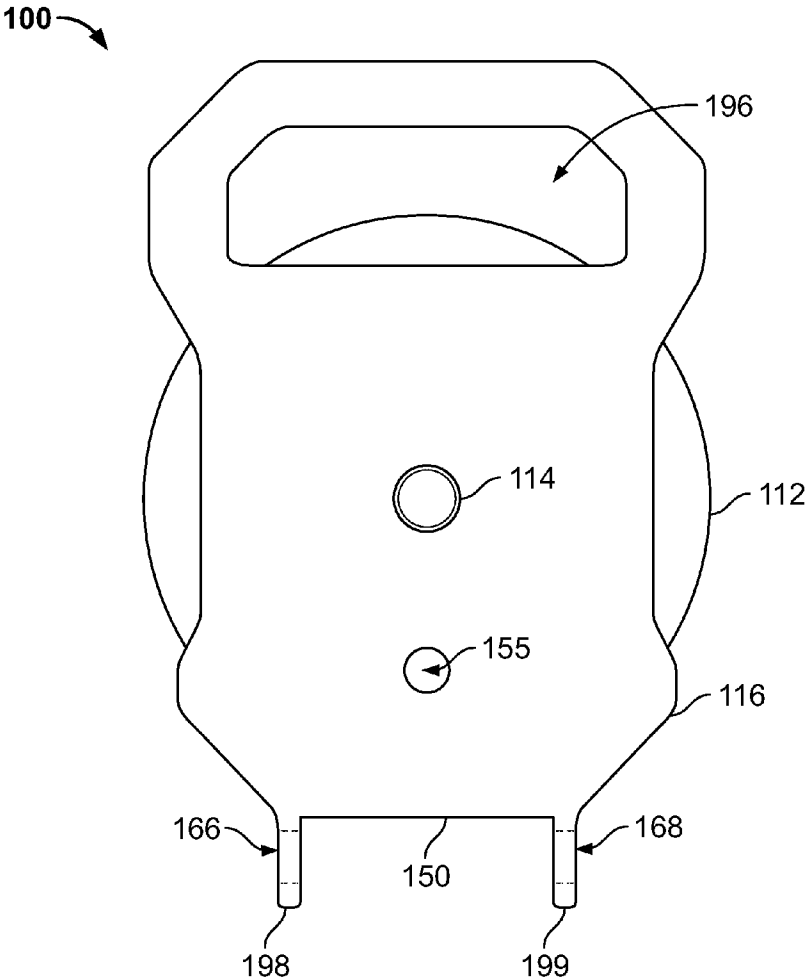
FIG. 9 is a front elevation view of a second embodiment of a pulley training system in accordance with the present invention.

Referring now to FIGS. 9 and 10, there is shown a second embodiment of a pulley training system 100 in accordance with the present invention. The pulley training system 100 comprises a pulley wheel 112 mounted an on axle 114 within a pulley housing 116. The pulley training system 100 may be used with the attachment strap 18, cord 20, clips 22 and 26, and other components of the first embodiment described above.

The pulley housing 116 comprises a first portion 142 extending over a first face 144 of the pulley wheel 112, a second portion 146 extending over a second face 148 of the pulley wheel, and a bottom portion 150 that joins the first portion to the second portion. The first and second portions extend substantially parallel to each other, and the bottom portion extends substantially perpendicular to the first and second portions. In one embodiment, an opening 196 is formed in the topmost portions of the first portion 142 and second portion 146 for securing an attachment strap, such as attachment strap 18, to the pulley housing.

As with the first embodiment, a locking hole 155 may be formed through the first portion 142 of the pulley housing 116, the second portion 146 of the pulley housing, and the pulley wheel 112. The locking hole is configured so that it can receive a locking pin, such as the locking pin 60, when the pulley wheel is correctly aligned. In one embodiment, the locking hole is positioned below the axle 114, so that it is easier for a user to reach the locking pin when the pulley housing is suspended higher in the air. The locking pin provides the pulley training system 100 with two modes: a "static" mode in which the pulley wheel is substantially prevented from rotating relative to the pulley housing and an "open" mode in which the pulley wheel is allowed to rotate freely relative to the pulley housing. Locking the pulley wheel creates kinetic friction between the pulley wheel and the cord 20 when the cord is pulled, creating greater resistance, which can be helpful for beginning users.

Extensions 198 and 199 may be welded to or formed in the bottom portion 150 of the pulley housing 116. A first clip hole 166 may be formed through the extension 198 and a second clip hole 168 may be formed through the extension 199. The first and second clip holes are sized to allow clips, such as clips 22 and 26, to be removably attached to the pulley housing 116 through the clip holes. In this configuration, the pulley training system 100 may be used for exercises that do not require the rotation of the pulley wheel 112, such as pull ups. Other hanging exercise devices, such as a boxing bag, may be hung from the clips in this configuration, making the pulley training system a central location for exercises of many different kinds.

Figure 12:
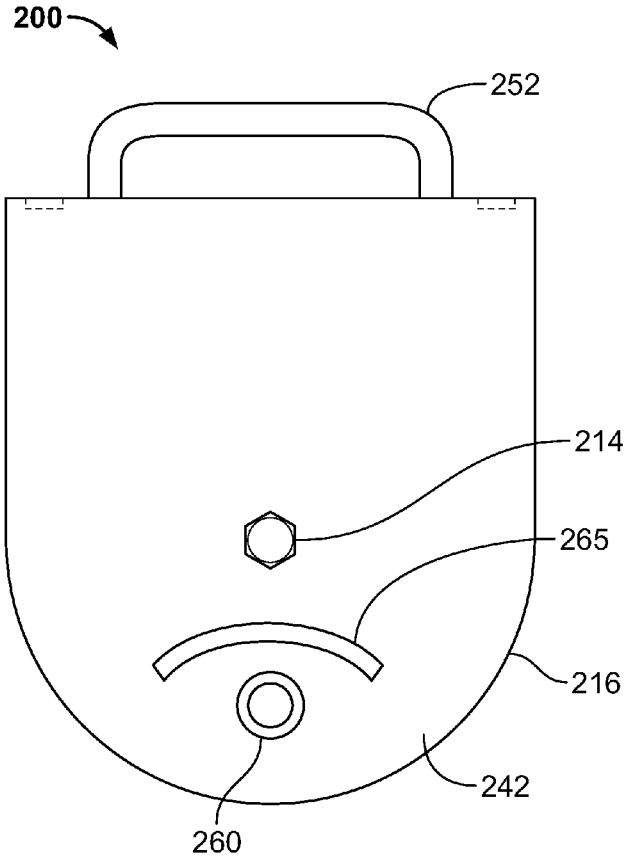
FIG. 12 is a front elevation view of a third embodiment of a pulley training system in accordance with the present invention.
Figure 13:
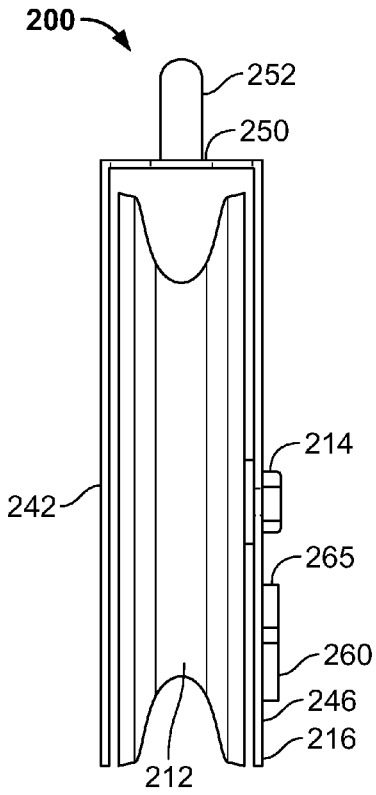
FIG. 13 is a side elevation view of the pulley training system of FIG. 12.

Referring now to FIGS. 12 and 13, there is shown a third embodiment of a pulley training system 200 in accordance with the present invention. The pulley training system 200 comprises a pulley wheel 212 mounted an on axle 214 within a pulley housing 216. The pulley training system 200 may be used with the attachment strap 18, cord 20, clips 22 and 26, and other components of the first embodiment described above.

The pulley housing 216 comprises a first portion 242, a second portion 246, and a top portion 250 that joins the first portion to the second portion. The first and second portions extend substantially parallel to each other, and the top portion extends substantially perpendicular to the first and second portions. In one embodiment, a steel attachment brace 252 may be welded to the top portion for securing an attachment strap, such as attachment strap 18, to the pulley housing.

Figure 16:
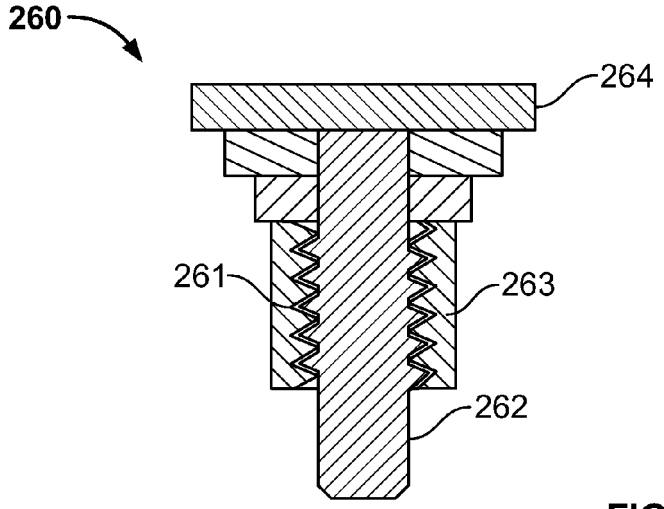
FIG. 16 is a side elevation view of a locking plunger for use with the pulley training system of FIG. 1, 9, 12 or 14, in accordance with an embodiment of the present invention.

As with the first and second embodiments, a locking hole may be formed through the first portion 242 of the pulley housing 216 and the pulley wheel 212. A spring-loaded locking plunger 260 (see FIG. 16) having a spring 261, a locking pin 262, a threaded guide 263, and a locking knob 264 may be affixed over the locking hole for locking the pulley wheel. In "static" mode, the locking pin 262 protrudes through the pulley housing into the pulley wheel, inhibiting the pulley wheel from rotating relative to the pulley housing. To retract the locking pin 262 out of the pulley wheel, a user pulls the locking knob against the spring force and rotates the locking knob ninety degrees. The locking plunger may include a guide cam to secure the locking pin 262 against inadvertently resetting. The locking pin 262 is preferably strong enough to handle several hundred pounds of side loading when engaged in the pulley wheel. The locking pin 262 and threaded guide may be made of steel. The locking knob may be made of plastic, such as polyamide, or knurled steel. In one embodiment, a crescent-shaped guard 265 is welded to the pulley housing proximate the locking plunger to protect the locking knob from shearing off if the pulley housing is dropped or hits a hard object. The locking plunger may be positioned below the axle 214, so that it is easier for a user to reach the locking knob when the pulley housing is suspended higher in the air. Locking the pulley wheel creates kinetic friction between the pulley wheel and the cord 20 when the cord is pulled, creating greater resistance, which can be helpful for beginning users.

Figure 15:
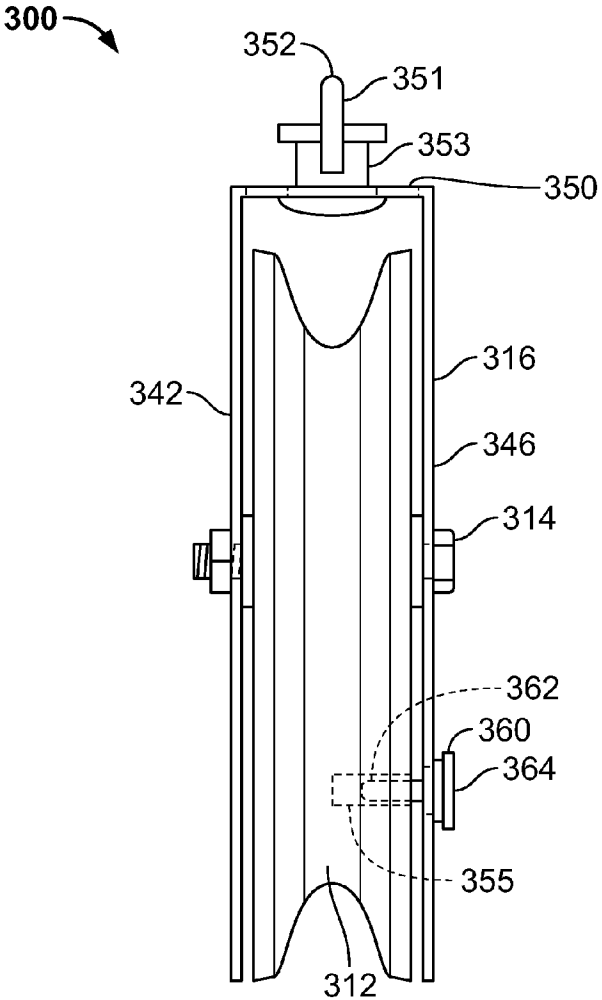
FIG. 15 is a side elevation view of the pulley training system of FIG. 14.
Figure 14:
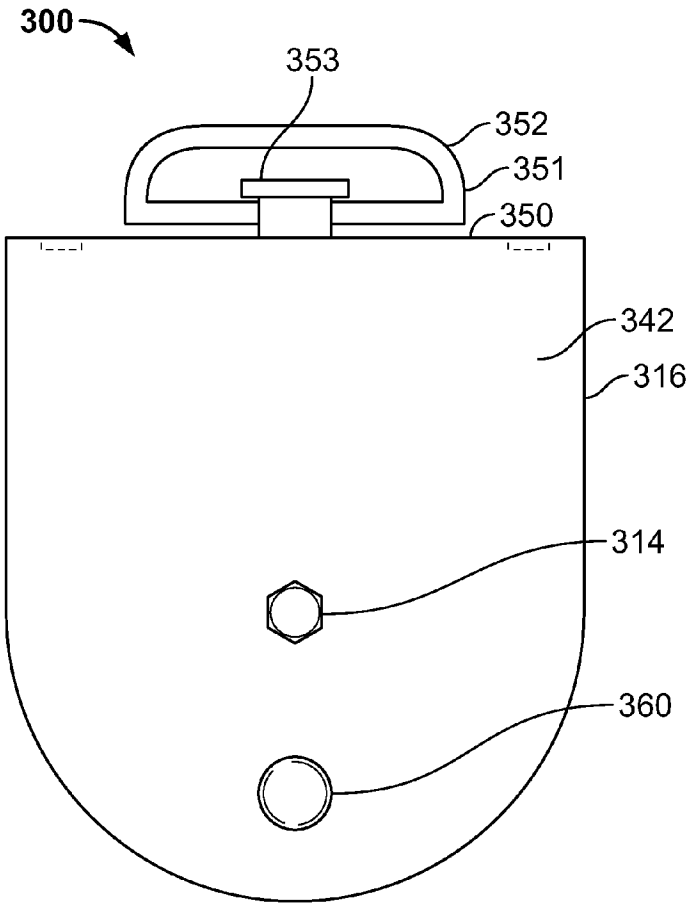
FIG. 14 is a front elevation view of a fourth embodiment of a pulley training system in accordance with the present invention.

Referring now to FIGS. 14 and 15, there is shown a fourth embodiment of a pulley training system 300 in accordance with the present invention. The pulley training system 300 comprises a pulley wheel 312 mounted an on axle 314 within a pulley housing 316. The pulley training system 300 may be used with the attachment strap 18, cord 20, clips 22 and 26, and other components of the first embodiment described above.

The pulley housing 316 comprises a first portion 342, a second portion 346, and a top portion 350 that joins the first portion to the second portion. The first and second portions extend substantially parallel to each other, and the top portion extends substantially perpendicular to the first and second portions. To inhibit the attachment strap 18 from becoming twisted, a swivel 351 comprising an attachment brace 352 and a bolt portion 353 may be attached to the top portion of pulley housing. The attachment strap may be secured to the attachment brace 352. In one embodiment, the attachment strap may be omitted, and the swivel may be attached directly to a supporting object, permanently affixing the pulley housing to the supporting object, such as a ceiling rack, ceiling beam, or specially designed free-standing rack. The swivel gives the pulley housing the ability to rotate through 360 degrees.

As with the third embodiment, a locking hole 355 may be formed through the first portion 342 of the pulley housing 316 and the pulley wheel 312. A locking plunger 360 having a locking pin 362 and a locking knob 364 may be attached over the locking hole for locking the pulley wheel. In "static" mode, the locking pin 362 protrudes through the pulley housing into the pulley wheel, inhibiting the pulley wheel from rotating relative to the pulley housing. In one embodiment, the locking plunger is positioned below the axle 314, so that it is easier for a user to reach the locking knob 364 when the pulley housing is suspended higher in the air. Locking the pulley wheel creates kinetic friction between the pulley wheel and the cord 20 when the cord is pulled, creating greater resistance, which can be helpful in creating more stability for beginning users.

In other embodiments, the pulley housing 16, 116, 216 or 316 could be widened to accommodate two or more pulley wheels within the housing. In this configuration, a user could perform multiple pulley-based exercises simultaneously using only one housing. Alternatively, a plurality of users could perform pulley-based exercises simultaneously using the same housing. Multiple pulleys inside the pulley housing could be arranged side by side, one in front of the other, one in back of the other, or in another suitable arrangement. In other further embodiments, the pulley wheel may be replaced with a series of small pulley wheels or rollers mounted in an arc within the pulley housing.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A pulley training system comprising:

a pulley housing;

a pulley wheel mounted on an axle within the pulley housing and having a first face and a second face;

a cord configured to be draped over the pulley wheel; and a magnetic locking pin configured to be hung from the pulley housing by a lanyard;

wherein the pulley housing comprises a first portion extending over the first face of the pulley wheel and having a first portion locking hole, and a second portion extending over the second face of the pulley wheel;

wherein a wheel locking hole is formed in the pulley wheel and is configured to be aligned with the first portion locking hole; and wherein the first portion locking hole and the wheel locking hole are configured so that they can be aligned with each other to receive the locking pin for inhibiting the pulley wheel from rotating relative to the pulley housing.

2. The pulley training system of claim 1, wherein:

a second portion locking hole is formed in the second portion of the pulley housing; and wherein the first portion locking hole, the second portion locking hole, and the wheel locking hole are configured so that they can be aligned with each other to receive a locking pin for inhibiting the pulley wheel from rotating relative to the pulley housing.

3. The pulley training system of claim 1, wherein a plurality of wheel locking holes are formed in the pulley wheel and are configured to be individually aligned with the first portion locking hole.

4. The pulley training system of claim 1, further comprising:

a first rope clamp attached at a first end of the cord to create a first loop at the first end of the cord; and a second rope clamp attached at a second end of the cord to create a second loop at the second end of the cord.

5. The pulley training system of claim 1, further comprising an attachment strap configured to be adjustably attached to the pulley housing for removably coupling the pulley training system to a supporting object.

6. The pulley training system of claim 5, wherein the pulley housing further comprises an attachment brace for securing the attachment strap to the pulley housing.

7. The pulley training system of claim 5, wherein an opening is formed in the pulley housing for securing the attachment strap to the pulley housing.

8. The pulley training system of claim 5, further comprising a swivel attached to the pulley housing, wherein the swivel comprises a bolt portion connected to the pulley housing; and an attachment brace rotatably mounted on the bolt portion for securing the attachment strap to the pulley housing.

9. The pulley training system of claim 5, further comprising a holding strap attached to the attachment strap for holding an excess portion of the attachment strap.

10. The pulley training system of claim 5, further comprising a wall/ceiling anchor configured to be removably coupled to the attachment strap for hanging the pulley training system from a wall or ceiling;

wherein the wall/ceiling anchor comprises a mounting plate for mounting the wall/ceiling anchor to a wall or ceiling, and a ring connected to the mounting plate for securing the attachment strap to the wall/ceiling anchor.

11. The pulley training system of claim 5, further comprising a door anchor configured to be removably coupled to the attachment strap for hanging the pulley training system from a door;

wherein the door anchor comprises a plate having a plurality of holes formed therein for receiving the attachment strap.

12. A pulley training system comprising:

a pulley housing;

a pulley wheel mounted on an axle within the pulley housing;

a cord configured to be draped over the pulley wheel;

a first clip configured to be attached proximate a first end of the cord; and a second clip configured to be attached proximate a second end of the cord;

wherein a first clip hole and a second clip hole are formed in the pulley housing in an area spaced from the pulley wheel; and wherein the first clip hole and the second clip hole are sized to allow the first clip to be removably attached to the pulley housing through the first clip hole and the second clip to be removably attached to the pulley housing through the second clip hole while the pulley housing is fixed to a support.

13. The pulley training system of claim 12, wherein:

the first clip is a carabiner; and the second clip is a carabiner.

14. The pulley training system of claim 13, further comprising:

a first grip configured to be removably attached to the first clip; and a second grip configured to be removably attached to the second clip.

15. The pulley training system of claim 14, wherein the first grip and second grip each comprise:

a substantially rigid handle; and a relatively flexible arm/foot cradle connected to the handle by a strap.

16. The pulley training system of claim 12, wherein the first clip hole and the second clip hole are located directly above the pulley wheel.

17. The pulley training system of claim 12, wherein:

the pulley housing comprises a first portion extending over a first face of the pulley wheel and defining a first plane, and a second portion extending over a second face of the pulley wheel and defining a second plane; and the first clip hole and the second clip hole are located substantially between the first plane and the second plane.

18. A pulley training system comprising:

a pulley housing;

a pulley wheel mounted on an axle within the pulley housing;

a cord configured to be draped over the pulley wheel;

a first clip configured to be attached proximate a first end of the cord; and a second clip configured to be attached proximate a second end of the cord;

wherein a first clip hole and a second clip hole are formed in the pulley housing in an area located directly above the pulley wheel; and wherein the first clip hole and the second clip hole are sized to allow the first clip to be removably attached to the pulley housing through the first clip hole and the second clip to be removably attached to the pulley housing through the second clip hole.

19. A pulley training system comprising:

a pulley housing;

a pulley wheel mounted on an axle within the pulley housing;

a cord configured to be draped over the pulley wheel;

a first clip configured to be attached proximate a first end of the cord; and a second clip configured to be attached proximate a second end of the cord;

wherein the pulley housing comprises a first portion extending over a first face of the pulley wheel and defining a first plane, and a second portion extending over a second face of the pulley wheel and defining a second plane;

wherein a first clip hole and a second clip hole are formed in the pulley housing in an area located substantially between the first plane and the second plane; and wherein the first clip hole and the second clip hole are sized to allow the first clip to be removably attached to the pulley housing through the first clip hole and the second clip to be removably attached to the pulley housing through the second clip hole.

* * * * *

UNITED STATES PATENT AND TRADEMARK OFFICE

CERTIFICATE OF CORRECTION

PATENT NO. : 8,152,704 B2
APPLICATION NO. : 12/683600
DATED : April 10, 2012
INVENTOR(S) : John P. Brice et al.

It is certified that error appears in the above-identified patent and that said Letters Patent is hereby corrected as shown below:

Column 2, line 32, “hag” should be -- bag --.

Column 4, line 2, “%” should be -- 3/8. --.

Column 5, line 5, “hack” should be -- back --.

Column 5, line 10, “%” should be -- 3/8 --.

Column 5, line 15, “hag” should be -- bag --.

Signed and Sealed this
Second Day of October, 2012

David J. Kappos

David J. Kappos
*Director of the United States Patent and Trademark Office*